US012790100B2

(12) United States Patent
Ho

(10) Patent No.: US 12,790,100 B2
(45) Date of Patent: Nov. 10, 2026

(54) CABLE COIL HOLDER

(71) Applicant: BANG & OLUFSEN A/S, Struer (DK)

(72) Inventor: Tee Hock Ho, Singapore (SG)

(73) Assignee: BANG & OLUFSEN A/S, Struer (DK)

( * ) Notice: Subject to any disclaimer, the term of this patent is extended or adjusted under 35 U.S.C. 154(b) by 120 days.

(21) Appl. No.: 18/833,465

(22) PCT Filed: Jan. 25, 2023

(86) PCT No.: PCT/DK2023/050014
§ 371 (c)(1),
(2) Date: Jul. 26, 2024

(87) PCT Pub. No.: WO2023/143684
PCT Pub. Date: Aug. 3, 2023

(65) Prior Publication Data

US 2025/0178820 A1 Jun. 5, 2025

(30) Foreign Application Priority Data

Jan. 26, 2022 (DK) ..... PA 2022 00075

(51) Int. Cl.
*B65D 85/04* (2006.01)

(52) U.S. Cl.
CPC ..... *B65D 85/04* (2013.01)

(58) Field of Classification Search
CPC .. B65D 85/04; B65H 75/364; B65H 75/4465; B65H 75/4473; B65H 75/2218
See application file for complete search history.

(56) References Cited

U.S. PATENT DOCUMENTS 1,878,306 A * 9/1932 Whittier ..... B65D 75/02 206/393
2,253,974 A * 8/1941 Guild ..... B65D 85/04 229/162.1
2,278,037 A * 3/1942 Mcintire ..... B65D 85/04 206/396
2,499,890 A * 3/1950 Themak ..... A61B 17/06128 242/159
2,971,231 A 2/1961 Stoddart
(Continued)

FOREIGN PATENT DOCUMENTS

FR 96 620 E 7/1973
GB 2 302 861 A 2/1997
(Continued)

OTHER PUBLICATIONS

International Search Report for PCT/DK2023/050014 mailed on Apr. 25, 2023.
Written Opinion for PCT/DK2023/050014 mailed on Apr. 25, 2023.

*Primary Examiner* — Sang K Kim
(74) *Attorney, Agent, or Firm* — Schmeiser Olsen PLLC

(57) ABSTRACT

A cable coil holder, a method of manufacturing a cable coil holder, a blank for forming a cable coil holder as well as use of a cable coil holder are provided, where the cable coil holder has a substantially cylindrical shape, the cable coil holder having a predetermined width equal to the height of the cylindrical shape limited by two opposing edges, and a material thickness perpendicular to the width thereby defining an outer side and an inner side, where one or more cut-outs are provided through the material thickness in one or both edges.

10 Claims, 7 Drawing Sheets

(56) References Cited

U.S. PATENT DOCUMENTS

| | | | | |
|---|---|---|---|---|
| 3,329,259 | A | 7/1967 | Mayer | |
| 3,796,304 | A | 3/1974 | Blais | |
| 4,979,614 | A | 12/1990 | Ruhaut | |
| 5,129,514 | A | 7/1992 | Lilley, Jr. | |
| 6,740,817 | B1 | 5/2004 | Anderson | |
| 8,844,726 | B2 | 9/2014 | Andre | |
| 9,896,301 | B2 * | 2/2018 | Walker | B65H 75/28 |
| 2007/0051662 | A1 | 3/2007 | Millar-Sax | |
| 2014/0096344 | A1 * | 4/2014 | Creato | B65D 85/04 24/16 PB |
| 2017/0088392 | A1 | 3/2017 | Wang | |
| 2017/0183196 | A1 * | 6/2017 | Kennedy | B65H 75/4473 |
| 2021/0296875 | A1 * | 9/2021 | Lee | B65H 75/4473 |

FOREIGN PATENT DOCUMENTS

| | | | |
|---|---|---|---|
| GB | 2 524 142 | A | 9/2015 |
| WO | 2011/028111 | A1 | 3/2011 |

* cited by examiner

CABLE COIL HOLDER

CROSS-REFERENCE TO RELATED APPLICATIONS

This application is a national stage of PCT Application No. PCT/DK2023/050014, having a filing date of Jan. 25, 2023, which is based on DK Application No. PA 2022 00075, having a filing date of Jan. 26, 2022, the entire contents both of which are hereby incorporated by reference.

FIELD OF TECHNOLOGY

The following relates to a cable coil holder, a blank for forming a cable coil holder, a method of forming a cable coil holder using the blank, as well as use of a cable coil holder to wind a cable up on the cable coil holder.

BACKGROUND

When purchasing electronic devices, such as mobile phones, earphones, GPS or a host of other devices, these devices are usually delivered with cables for charging, or connecting to other devices. Often the cables have a length of from 50 cm to 2 m. Traditionally the cables are loosely coiled and held together by one or more cable ties. One problem with this manner of keeping the cable tidy is that the cable is exposed to a number of +180 degrees bends (one for each loop). After being released the cable will tend to retain the shape. A further disadvantage of this manner of coiling the cable is that it is not aesthetically pleasing. When a consumer has bought an expensive electronic gadget with a special design, the "cheap" cable coil tends to spoil the presentation of the product in its box, and thereby the initial overall brand impression.

In the conventional art there have been several attempts to address this problem, such as for example disclosed in any of U.S. Pat. Nos. 2,971,231, 8,844,726, 3,329,259, 5,129,514, US 2007/051662, U.S. Pat. No. 3,796,304, US 2017/088392, and others.

All these conventional art devices and methods have various drawbacks. Some of the solutions involve advanced cut and folded cardboard devices or a plurality of cable ties, combinations of wrapping and specially molded boxes, or cable containers requiring a lot of material thereby creating a lot of waste. Furthermore, few of them are designed for re-use, so once the cable has been withdrawn from a device the device is to be discarded. Re-use for general storage of the cable in the original packaging appears to be either very cumbersome or impossible as the packaging is destroyed during the unpacking.

Consequently, there is a need for a simple, reliable, non-expensive and re-useable cable coil holder or device of the type described above. Furthermore, the cable coil holder shall have a minimal environmental impact and be sustainable. It may be made from any of a variety of sustainable, recyclable or reusable materials.

SUMMARY

An aspect relates to a cable coil holder having a substantially cylindrical shape, the cable coil holder having a predetermined width equal to the height of the cylindrical shape limited by two opposing edges, and a material thickness perpendicular to the predetermined width thereby defining an outer side and an inner side of the cable coil holder, where one or more cut-outs are provided through the material thickness in one or both of the two opposing edges.

The cross-section of the cylindrical shape may substantially take any shape, but in embodiments desired shapes may include elliptical, oval or circular or other shapes without sharp corners in-between. In this manner it is achieved that the cable when arranged on the cable coil holder is not exposed to any sharp bends. If the cable coil holder has a circular cross-sectional shape the diameter in embodiments may be between 70 mm and 90 mm. However, it is also contemplated to have cable coil holders having smaller and larger diameters.

The cable coil holder's width equal to the height of the cylindrical shape limited by two opposing edges, shall be understood as the distance between the two opposing side edges, or the height of the cable coil holder when it is placed on a flat surface, for example, on a desk or inside a flat box.

The manner in which the cable coil holder is used is also described below with reference to the use of a cable coil holder but in short the intention and how to use the cable coil holder is to fasten one end of the cable in one of the cut-outs provided through the material thickness in one or both of the two opposing edges and thereafter wind the cable around the cable coil holder either on the inside or on the outside. The still free end of the cable which is wound around the cable coil holder is finally inserted into a cut-out on the opposing edge and as such the cable is neatly and tidily wound around the cable coil holder. Due to the position of the end of the cables in separate cut-outs, the cable is firmly held on the cable coil holder. In this position the cable with the cable coil holder may be packaged with the electronic device or may be stored. As the cable is to be used, an end of the cable is liberated from the cut-out in one edge and the cable is unwound from the cable coil holder and finally the opposite end may be liberated from the cut-out in the opposing edge. In this manner the cable has been stored on the cable coil holder without introducing significant bends to the cable and at the same time the cable has been held in an orderly and secure fashion on the cable coil holder. Likewise, when it is desired to store the cable for example after the electronic device has been charged, one end of the cable is inserted into a cut-out in one edge and the cable is wound around the cable coil holder until the second end of the cable may be positioned in a cut-out in the opposing edge.

In an embodiment of the invention the material from which the cable coil holder is manufactured is flexible.

Although it may be contemplated to manufacture the cable coil holder by a manufacturing method resulting in a stiff/rigid cable coil holder, it may be advantageous to manufacture the cable coil holder from a material which is flexible in embodiments. This among other advantages provides the advantage that for example after a cable has been wound onto the cable coil holder as described above may be inserted into a package or positioned in a storage place where it may be necessary to alter the shape of the cable coil holder in order to precisely fit the cable with the cable coil holder in the designated location.

In a still further embodiment, the flexible material is selected from one or more of: paper, cardboard, polymer, plastic or a PU foam.

In some embodiments of the invention, a device holder is provided on the inner side of the cable coil holder.

In embodiments, the device holder may be shaped and have a size suitable to accommodate for example a dongle or a jack converter, or the like such that the cable coil holder may be provided with one type of cable connector, where in use it may be advantageous to alter the interface i.e., the jack of the cable in one end and therefore provide a jack converter in a handy position i.e., inside the cable coil holder itself. Likewise, if the cable which is wound onto the cable coil holder is for a specific device requiring, for example, blue tooth communication such as for example a wireless mouse or the like, it may be advantageous in embodiments to provide the dongle in which the communication electronics is provided together with the cable such that the mouse, cable and dongle may be provided as one package with the dongle in a safe and recognizable position. Typically, the device holder will be provided on the inner side of the cable coil holder and as such the cable is to be wound on the outside of the cable coil holder.

In an embodiment of the invention, one or more flange sections are provided on one or both of the two opposing edges, the one or more flange sections being perpendicular to the outer and/or inner sides, where when more than one flange section is provided, the flange sections are distributed along the edge. These flanges are provided in order to guide the cable as it is wound around either the inside or the outside of the cable coil holder such that the cable during the winding process will not slide off the cable coil holder's either inner or outer surface. Typically, the flanges will be made from the same material as the cable coil holder itself.

Although it is contemplated to manufacture the cable coil holder using a variety of technologies such as for example injection moulding or in an additive manufacturing process, in embodiments a desired manufacturing process includes the use/manufacture of a blank which then may be folded into a cable coil holder as described above. In this connection a blank shall be understood as a substantially flat almost two-dimensional object i.e., that the length and width is considerable in comparison to the thickness of the material from which the blank is made. Blanks may typically be made in a punching process where a die is made to define the outer periphery of the blank and additionally in the tool or in separate tools means for providing scoring lines on the blank may be provided.

Consequently, embodiments of the invention are also directed to a blank for assembling a cable coil holder, where the blank is a rectangular strip of material having a width limited by two opposing edges, and a length limited by a first end and a second end, and a material thickness perpendicular to the width, and where adjacent the first end a connector is provided and adjacent the second end a receiving portion is provided, where the receiving portion is adapted to receive and hold the connector, and where one or more cut-outs is/are provided in one or both edges.

The manufacture of blanks is typically a rather economical process once the die cut tools have been purchased and furthermore, storage and transport of blanks in their flat configuration is also economical. A substantial number of blanks may be transported in the flat configuration of the blank, thereby leaving a minimal CO2 footprint during transport. As the blanks may be assembled into a cable coil holder in a relatively simple manner, the overall use of a blank in order to manufacture a cable coil holder according to embodiments of the present invention may be advantageous. Furthermore, in embodiments where the blanks/cable coil holder is manufactured from paper or cardboard the cable coil holder as such is also compostable and biodegradable, and therefore does not leave any undesired issues when discarded in a proper manner.

In an embodiment of the invention, the blank is provided with an integral and continuous secondary blank section extending from the second end of the blank where the secondary blank section having a width corresponding to the width of the blank, and where on either side of the secondary blank flaps extend, where each flap is provided with a connection flange, further extending from the flap, such that when the flaps are folded orthogonal to and along the blank's edges, the connection flanges will overlap. This secondary blank section may when folded provide the device holder as described above and by dimensioning the flaps and connection flanges appropriately the flaps and connection flanges may when folded be designed to accommodate various sized of devices such as dongles, jack converters etc.

In an embodiment of the invention the connector may be a tap, the tap having a width less than the width of the blank, and where the receiving portion is a slot, where the tap is adapted to be inserted and received in the slot.

Therefore, by inserting the tap through the slot, the blank is shaped into a cable coil holder having a cylindrical shape with a cross section without sharp corners (such as circular, oval, elliptical or similar) in a simple and easy manner. Typically, the tap will be provided with small slits adjacent the interface between the tap and the first end such that the tap may have a width wider than the slot but the distance between the slits have more or less the same distance as the width of the slot in the width direction of the blank such that the tap will expand once it is inserted through the slot thereby retaining the tap in a secure manner by the slot in the second end of the blank.

In desired embodiments the blank may have a length between 200 and 500 mm, for example between 250 and 350 mm, and as a further example, 300 mm, and/or a width between 15 and 55 mm, for example, between 17 and 40 mm, and as a further example between 25 and 35 mm, and optionally where the material thickness is selected between 0.3 mm and 4 mm, for example between 0.5 and 1 mm.

These measurements will provide cable coil holders suitable to accommodate most cables and wires supplied with smaller consumer electronic devices.

Embodiments of the invention are also directed to a method of forming a cable coil holder as described above using a blank also as described above where the blank being a rectangular strip of material having a width limited by two opposing edges, and a first end and a second end, and where adjacent the first end a connector is provided and adjacent the second end a receiving portion is provided, where the blank is manipulated such that the connector engages and is held by the receiving portion, whereby the blank attains a cylindrical shape such that one edge forms one perimeter, and the opposing edge forms another perimeter and the width of the blank is the height of the cylinder, between the two perimeters.

In a further method step is provided that the blank further comprises a secondary blank section which secondary blank section is integral and continuous with the blank, and extending from the second end, the secondary blank section having a width corresponding to the width of the blank, and where on either side of the secondary blank flaps extend, where each flap is provided with a connection flange, further extending from the flap, such that when the flaps are folded orthogonal to and along the blank's edges, the connection flanges will overlap, such that after the connector is received in the receiving section, the flaps are bent, whereby the connection flanges overlap and are assembled in a manner such that the secondary blank section overlaps part of the blank, forming a cavity between the blank and the secondary blank section, which cavity is limited by the blank and the secondary blank section, and the flaps along either edge.

It is also contemplated in a further embodiment that an aperture may be formed either in the blank or the secondary blank section where it overlaps the cavity. This aperture provides access to the device holder in the assembled configuration of the cable coil holder such that the extra devices such as dongles, jack connector etc. may be inserted or withdrawn from the device holder.

Embodiments of the invention are also directed to the use of a cable coil holder as described above where a cable is wound around either the inside or outside of the cable coil holder, where initially an end of the cable is inserted in a cut-out in one edge after which the cable is wound around the cable coil holder, such that the opposite end of the cable is inserted in a cut-out in the other edge.

Usually, the cable is wound onto the cable coil holder by initially inserting the cable adjacent one end of the cable-typically provided with a jack, headphone connector or the like in a cut out in one edge. Subsequently the cable is wound around the cable coil holder, such that the opposite end of the cable is inserted in a suitable cut-out on the opposing edge. Hereby the cable is maintained on the cable coil holder in a tight, not stretched manner and ready for use, simply by unrolling the cable. In cable coil holder embodiments not including a device holder the cable may be wound onto the inside or outside. However, where a device holder is provided as specified above the cable is wound on the outside, and a dongle, jack converter, or other accessory may be placed in the device holder.

Some of the embodiments will be described in detail, with reference to the following figures, wherein like designations denote like members, wherein.

DETAILED DESCRIPTION

Figure 1:
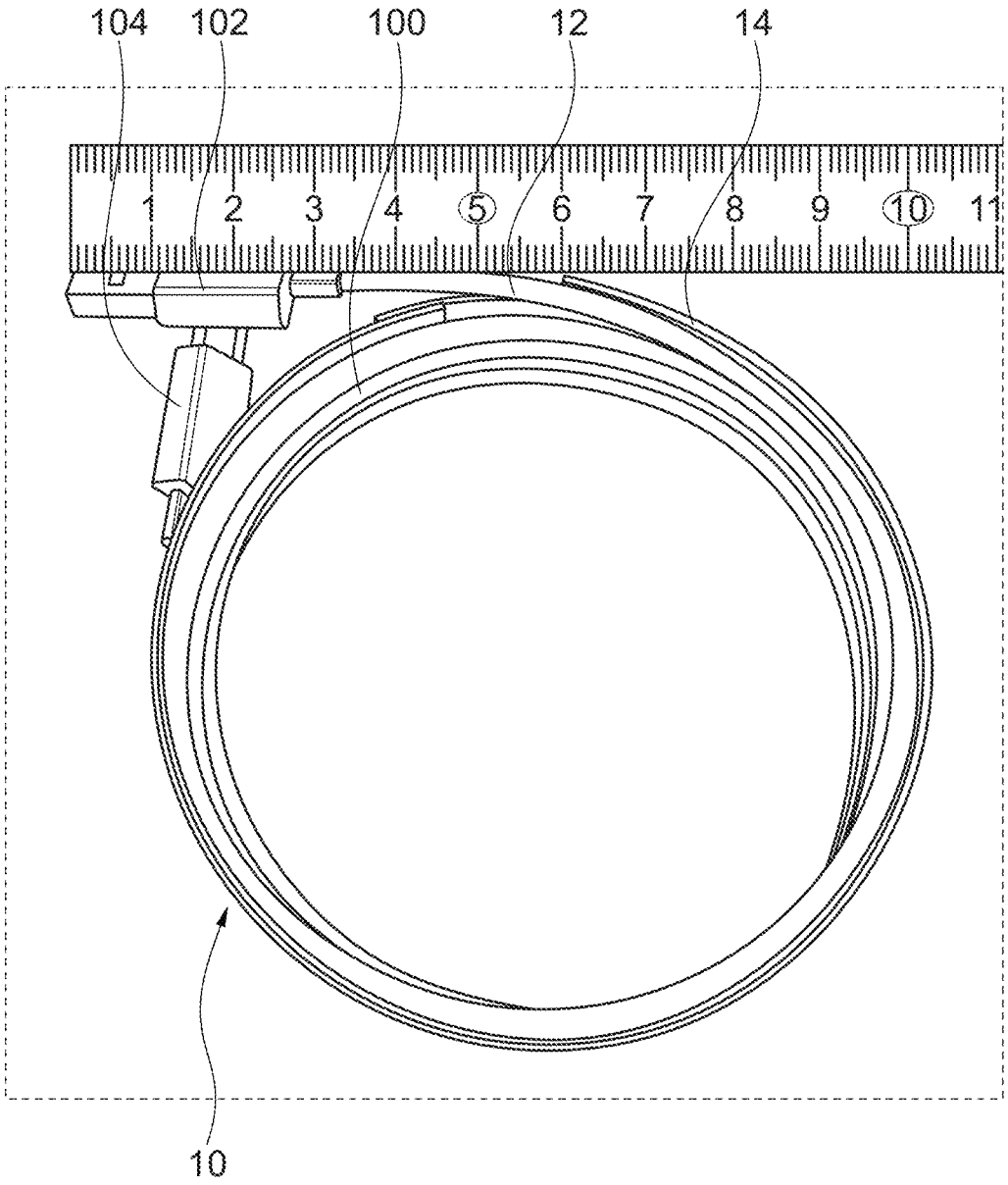
FIG. 1 illustrates a cable coil holder according to embodiments of the present invention.

Embodiments of the present invention will be described with respect to certain drawings. The drawings described are only schematic and are non-limiting. Each drawing may not include all of the features of embodiments of the invention and therefore should not necessarily be considered to be an embodiment of the invention. In the drawings, the size of some of the elements may be exaggerated and not drawn to scale for illustrative purposes. The dimensions and the relative dimensions may not correspond to actual reductions to practice of embodiments of the invention.

Furthermore, terms first, second, third and the like in the description and in the claims are used for distinguishing between similar elements and not necessarily for describing a sequence, either temporally, spatially in ranking or in any other manner.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "composing" or "comprising" as used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other integers, steps or components or groups thereof.

Similarly, it should be appreciated that in the description various features of embodiments of the invention are sometimes grouped together in a single embodiment, figure, or description thereof for the purpose of streamlining the disclosure and aiding in the understanding of one or more of the various inventive aspects of the disclosure. However, it is not to be interpreted as reflecting an intention that embodiments of the claimed invention require more features than are expressly recited in each claim.

Furthermore, while some embodiments described herein include some features included in other embodiments, combination of features of different embodiments are meant to be within the scope of embodiments of the invention, as will be understood by those skilled in the conventional art. For example, in the following claims any of the claimed embodiments can be used in any combination.

In the description provided herein numerous specific details are set forth. However, it is understood that embodiments of the invention may be practiced without these specific details. In other instances, well-known methods, structures and techniques have not been shown in detail in order not to obscure the understanding of the description.

The principles of embodiments of the invention will now be described by a detailed description of at least one drawing relating to exemplary features of embodiments of the invention. It is clear that other arrangements can be configured according to the knowledge of persons skilled in the conventional art without departing from the underlying concept or technical teachings of embodiments of the invention. Embodiments of the invention being limited only by the terms of the appended claims.

In FIG. 1 is illustrated an embodiment of the cable coil holder according to embodiments of the invention where the cable is wound on the inside of the cable coil holder.

In FIG. 1 the cable coil holder 10 has a substantially circular cross-sectional shape. A cable 100 is wound several times around the inside of the cable coil holder 10 such that the ends of the cable provided with jacks 102, 104 are arranged outside the cable coil holder 10. In order to retain the cable 100 in the desired position, the cable coil holder is provided with cut-outs 12 in the edge 14 such that by simply inserting the cable 100 through a cut out 12 in the edge 14, a first end of the cable 100 adjacent to jack 102 will be held along the first edge 14 whereas the second end of the cable 100 adjacent to the jack 104 will likewise be inserted in a cut out 18 (not visible) in the opposing edge 16 (not visible) of the cable coil holder 10.

Figure 2:
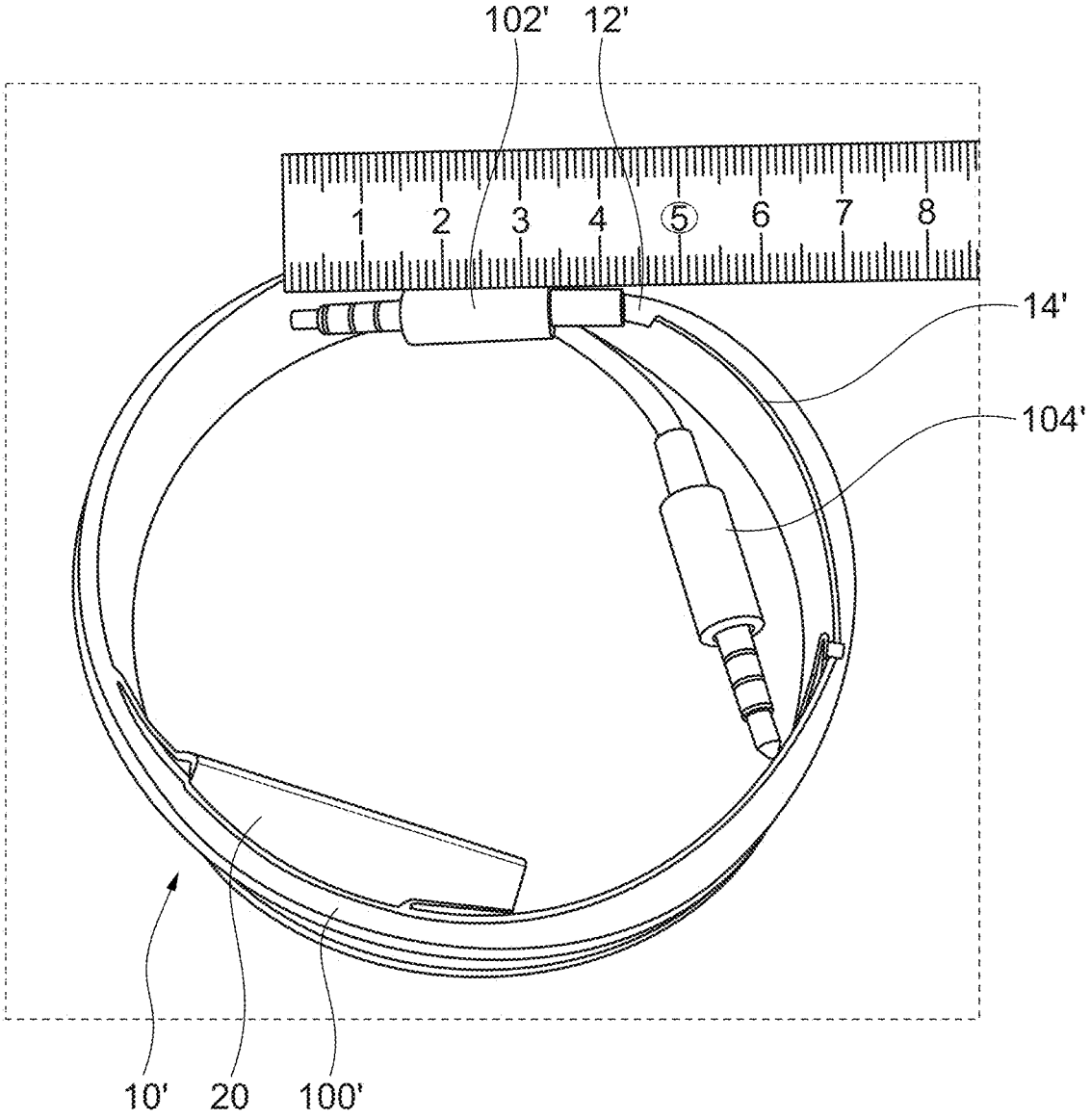
FIG. 2 illustrates another embodiment of the cable coil holder.

In FIG. 2 is illustrated a cable coil holder according to embodiments of the present invention where the cable is wound on the outside of the cable coil holder.

In FIG. 2 a cable coil holder 10' similar to the cable coil holder 10 discussed above is illustrated. The cable coil holder 10' is illustrated with a device holder 20 and furthermore, the cable 100' is wound on the outside of the cable coil holder 10'. The ends of the cable adjacent to the jacks 102', 104' are, as was the case above with reference to FIG. 1, retained in one of the cut outs 12' provided in the edge 14' and in one of the cut-outs 18' (not visible) provided in the edge 16' (not visible) of the cable coil holder 10'. The embodiment illustrated in FIG. 2 is furthermore provided with a device holder 20 integrally formed together with the cable coil holder 10'. The device holder 20 is suitable to accommodate for example a dongle, a jack convertor or the like. In this manner the peripheral equipment used together with either the electronic device which the cable is provided with or needed for the cable itself, may be stored in the cable coil holder 10' and thereby in the immediate vicinity of where it is to be used.

Figure 3:
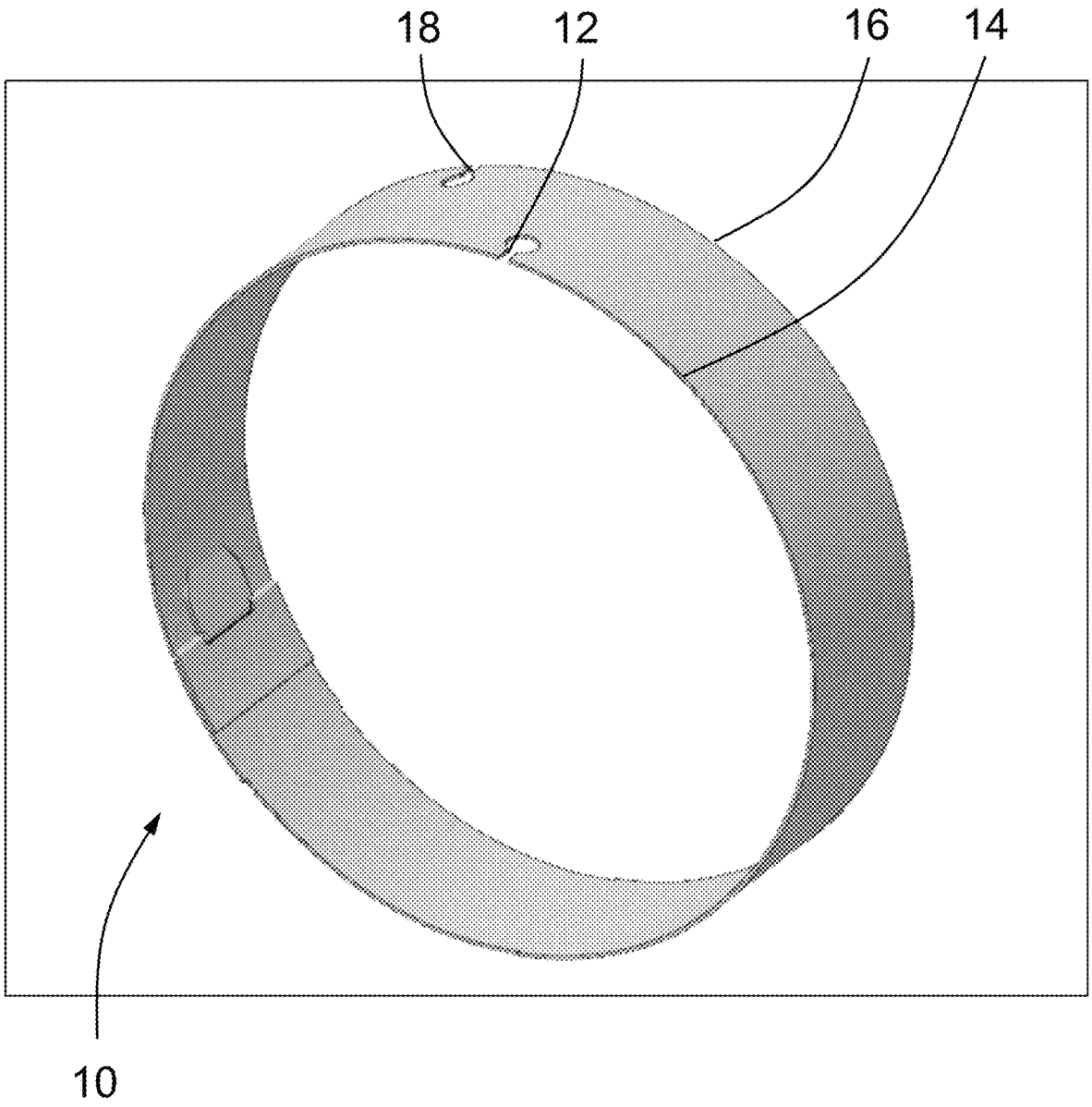
FIG. 3 illustrates the same cable coil holder as illustrated in FIG. 1 without cables wound either outside or inside the cable coil holder.
Figure 4:
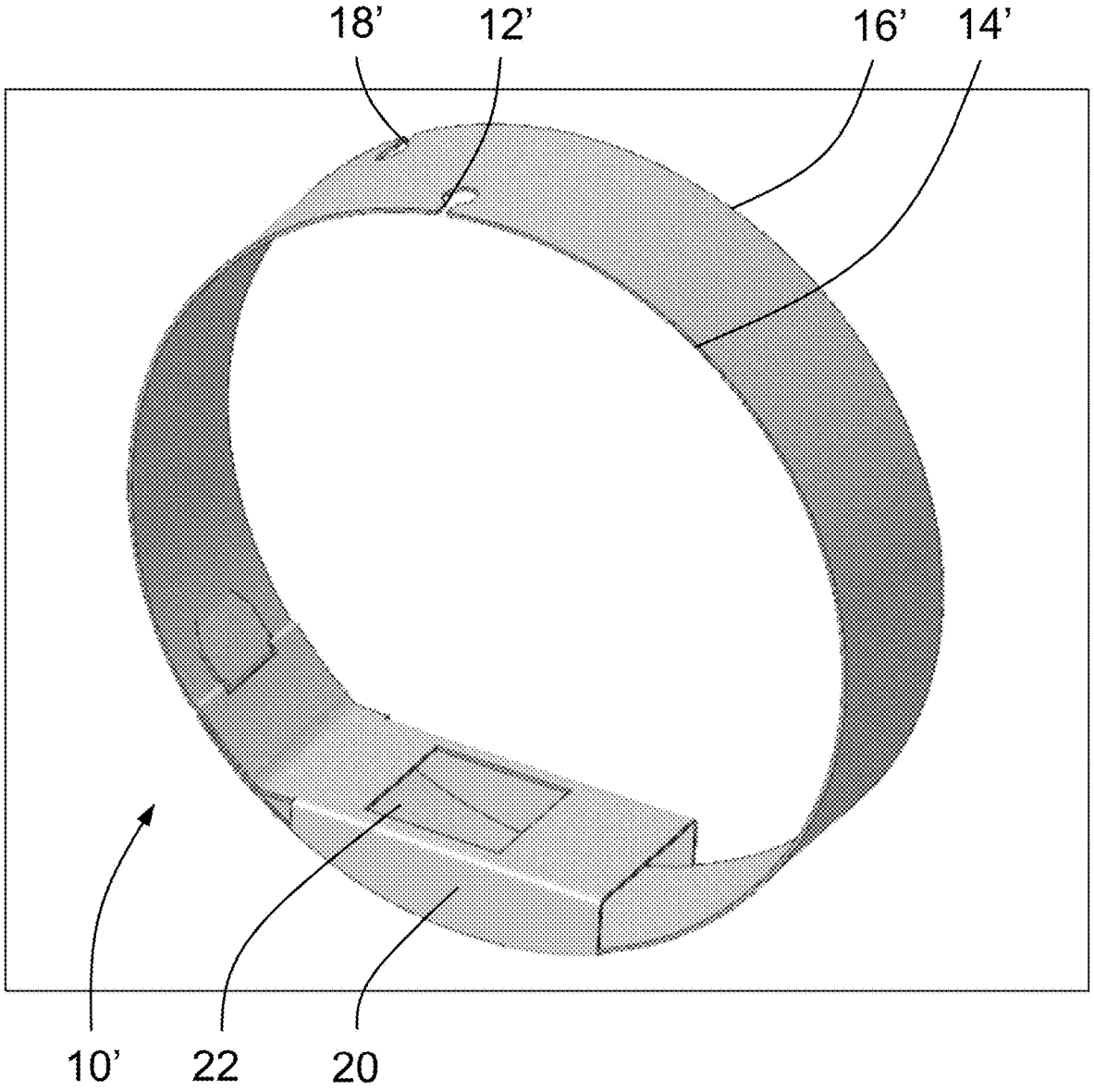
FIG. 4 illustrates the same cable coil holder as illustrated in FIG. 2 without cables wound either outside or inside the cable coil holder.

In FIGS. 3 and 4 are illustrated the same cable coil holders 10, 10' without the cables wound either outside or inside the cable coil holder 10, 10'. In FIG. 3 the cut-outs 12, 18 are clearly visible in respect to side edges 14, 16. Furthermore, in FIG. 4, the device holder 20 may be seen as folded integrally with the cable coil holder 10' as such. In the device holder 20 is provided an aperture 22, which aperture serves to provide access to items held or to be held in the device holder 20 as discussed above.

Figure 5:
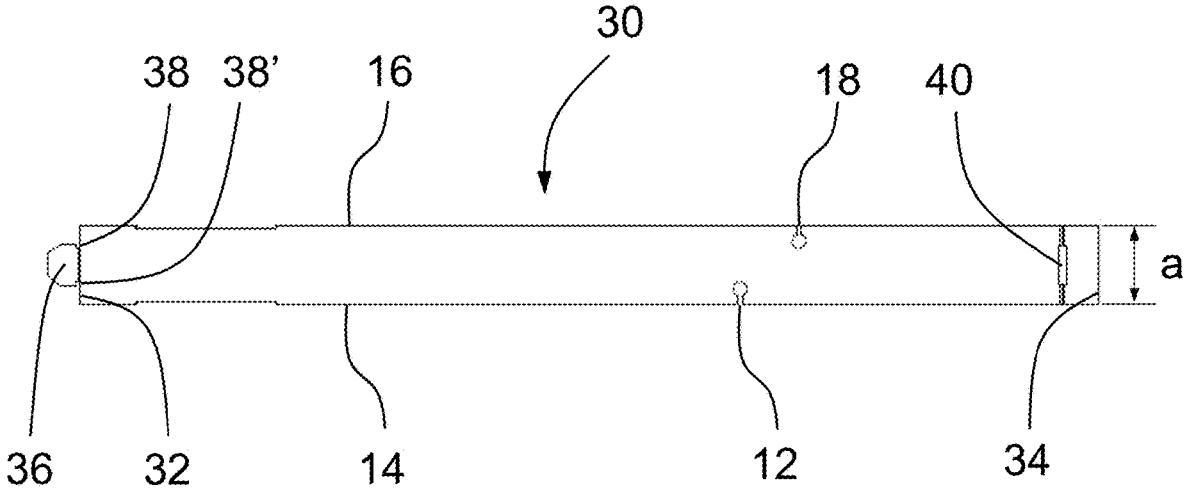
FIG. 5 illustrates a blank for use to form cable coil holders as illustrated in FIGS. 1 to 4.
Figure 6:
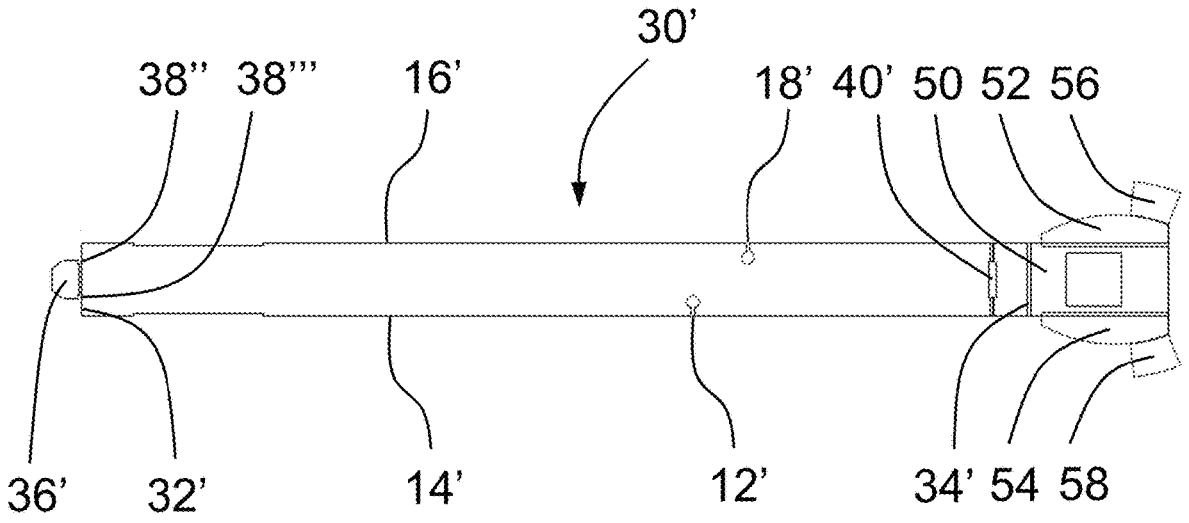
FIG. 6 illustrates a blank for use to form cable coil holders as illustrated in FIGS. 1 to 4.

The cable coil holders 10, 10' illustrated in FIGS. 1-4 are manufactured from a blank 30, 30', see FIGS. 5 and 6. In general, the blanks 30, 30' have in common a rectangular strip of material having a width limited by two edges 14, 16, 14' 16'. The length of the blanks 30, 30' is limited by a first end 32, 32' and a second end 34, 34'. Extending from the first end 32, 32' is provided a connector 36, 36' which in this embodiment is in the shape of a tap. In the interface between the tap 36, 36' and the first end 32, 32' are provided two slits 38, 38' and 38", 38" Adjacent the second end 34, 34' is provided a receiving portion 40, 40' which in this embodiment is in the shape of a slot. The width of the slot 40, 40' is designed such that the part of the tap 36, 36' between the slits 38, 38' and 38", 38'" may be accommodated. In this manner, the taps 36, 36' when inserted through the slot 40, 40' in the blank will be securely connected thereby forming the blank 30, 30' into a cable coil holder 10, 10' having in this embodiment a cylindrical shape with a circular cross-sectional shape. It is clear that deformation of the circular cross-sectional shape into for example an elliptical shape or an oval shape is rather easy to effect and will not have any influence on the proper functioning of the cable coil holder 10, 10' or the inventive features associated with the cable coil holder as such.

The blanks 30, 30' are furthermore provided with cut-outs 12, 18, 12', 18' provided in either edge 14, 16, 14', 16'.

Turning to the blank 30' illustrated in FIG. 6, this blank is additionally to the features described with reference to the blank 30 in FIG. 5 provided with sections which when folded will be folded into the device holder 20 as described above with for example reference to FIG. 2.

The device holder's 20 construction is achieved by providing a secondary blank section 50 extending and being integral with the second end 34'. The secondary blank section 50 has a width substantially corresponding to the width a of the blank itself 30'. Along the side edges of the secondary blank section 50 extend flaps 52, 54 on either side. From the flaps 52, 54 further extend connection flanges 56, 58 such that when the flaps 52, 54 are bent orthogonally to the secondary blank section 50 and the connection flanges 56, 58 are further bent orthogonally to the flaps 52, 54, the connection flanges 56, 58 will either interconnect or will be fastened to the blank itself thereby constituting a device holder 20 (see FIG. 2) limited along the edges 14', 16' by the flaps 52, 54 and downwards by the blank 30' itself and upwards by the secondary blank section 50.

The blank 30 illustrated and described with reference to FIG. 5 will, when assembled into a cable coil holder 10 according to embodiments of the present invention have a shape as illustrated in FIG. 3. Likewise, when the blank 30' described with reference to FIG. 6 is folded into a cable coil holder 10' according to embodiments of the present invention it will have a presentation as illustrated with reference to FIG. 4.

The blank may be manufactured from any suitable material. However, in embodiments desired materials maybe selected from cardboard or heavy paper or polymer sheets such as sheets having materials as PVC, PE, or foam materials such as PU foams and the like. These materials are readily available. The blanks manufactured as described above will have a flat configuration and as such be easy to store and transport. Furthermore the assembly is easily achieved, and after use-if they are not to be reused, they are easily dismantled. In the flat state they also only take up minimal space in the trash.

Figure 7:
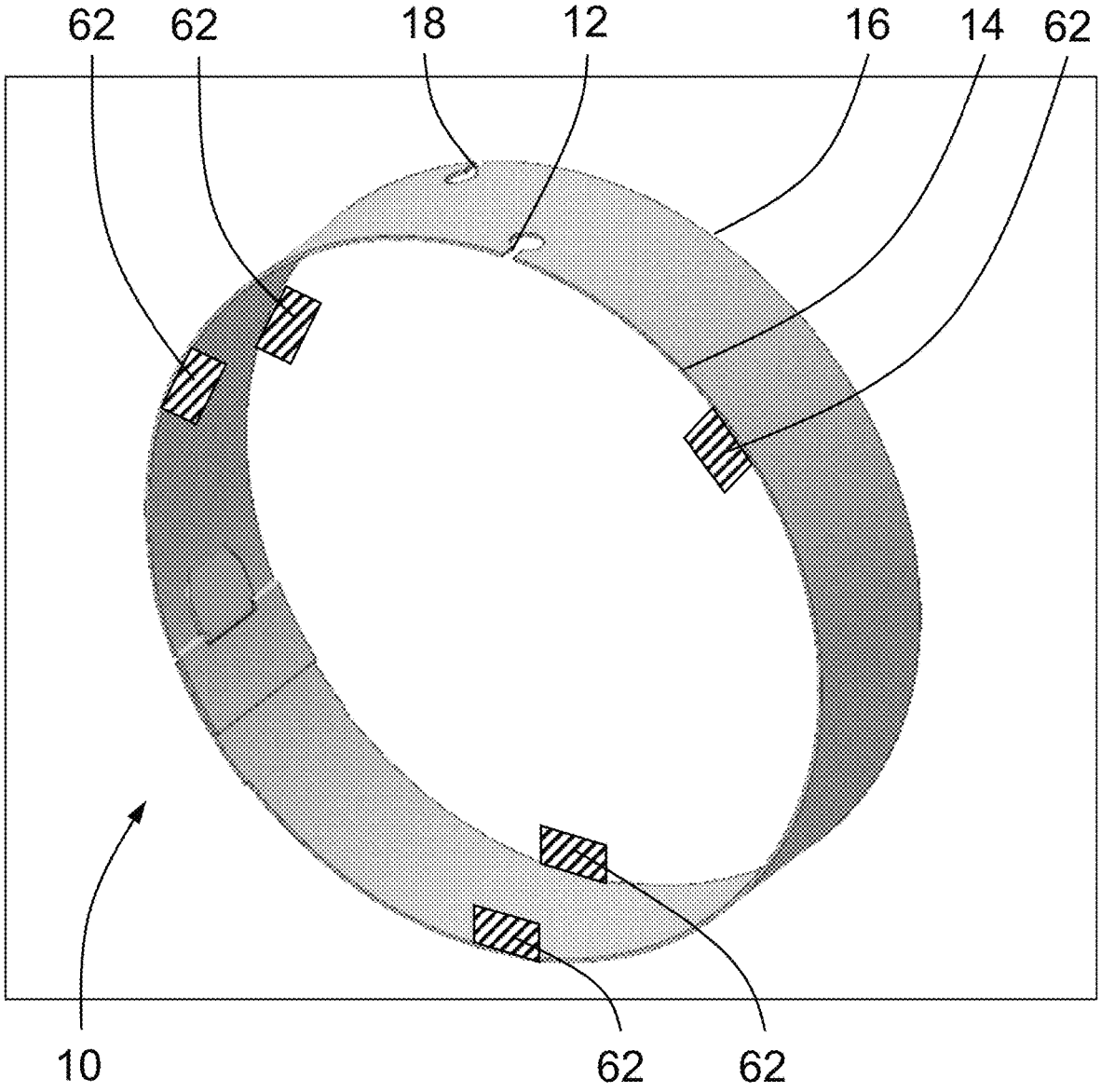
FIG. 7 illustrates a cable coil holder with flanges.

In FIG. 7 is illustrated an embodiment of a cable coil holder where small flanges 62 are arranged extending from the edges 14,16. These flanges 62 serve to guide and maintain the cable (not illustrated) on the cable coil holder 10. In the embodiment illustrated in FIG. 7, the flanges 62 are bent so they will guide/hold a cable wound onto the inside of the cable coil holder 10. It is however clear that by bending the flanges 62 in the opposite direction they will be able to guide and hold a cable on the outside of a cable coil holder 10 in the same manner.

Although only one cut-out is 12,12',18,18' is illustrated in each edge 14,14',16,16' a plurality of spaced cut-outs may be arranged along the edges. In use an end of a cable may therefore be inserted in the nearest cut-out, such that only short cable ends extend on the side where the cable is not wound onto.

Although the present invention has been disclosed in the form of embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A blank for assembling a cable coil holder, the cable coil holder having a substantially cylindrical shape, and a predetermined width equal to the height of the cylindrical shape limited by two opposing edges, and a material thickness perpendicular to the predetermined width thereby defining an outer side and an inner side of the cable coil holder, where one or more cut-outs are provided through the material thickness in one or both of the two opposing edges, where the blank is a rectangular strip of material having a width limited by two opposing edges, and a length limited by a first end and a second end, and a material thickness perpendicular to the width, and where adjacent the first end a connector is provided and adjacent the second end a receiving portion is provided, where the receiving portion is configured to receive and hold the connector, and where one or more cut-outs is/are provided in one or both edge and where integral and continuous with the blank, and extending from the second end a secondary blank section is provided, the secondary blank section having a width corresponding to the width of the blank, and where on either side of the secondary blank, flaps extend, where each flap is provided with a connection flange, further extending from the flap, such that when the flaps are folded orthogonal to and along the blank's edges, the connection flanges will overlap.

2. The blank according to claim 1, where the connector is a tap, the tap having a width less than the width of the blank, and where the receiving portion is a slot, where the tap is configured to be inserted and received in the slot.

3. The blank according to claim 1, where the blank has a length between 200 and 500 mm and/or a width between 15 and 55 mm, and where the material thickness is selected between 0.3 mm and 4 mm.

4. A cable coil holder formed from the blank according to claim 1, having a substantially cylindrical shape, the cable coil holder having a predetermined width equal to the height of the cylindrical shape limited by two opposing edges, and a material thickness perpendicular to the predetermined width thereby defining an outer side and an inner side of the cable coil holder, where one or more cut-outs are provided through the material thickness in one or both of the two opposing edges and wherein a device holder is provided on the inner side.

5. The cable coil holder according to claim 4, wherein the material, from which the cable coil holder is manufactured, is flexible.

6. The cable coil holder according to claim 5, wherein the material is selected from one or more of: paper, cardboard, polymer, plastic or a PU foam.

7. The cable coil holder according to claim 4, wherein one or more flange sections are provided on one or both of the two opposing edges, the one or more flange sections being perpendicular to the outer and/or inner sides, where when more than one flange section is provided, the flange sections are distributed along the edge.

8. A use of a cable coil holder according to claim 4, where a cable is wound around either the inside or outside of the cable coil holder, where initially an end of the cable is inserted in the cut-out in one edge after which the cable is wound around the cable coil holder, such that the opposite end of the cable is inserted in the cut-out in the other edge and a dongle, jack converter, or other accessory is placed in the device holder.

9. A method of forming a cable coil holder from a blank according to claim 1 into a cable coil holder, where the blank being a rectangular strip of material having a width limited by two opposing edges, and the first end and the second end, and where adjacent the first end the connector is provided and adjacent the second end a receiving portion is provided, where the blank is manipulated such that the connector engages and is held by the receiving portion, whereby the blank attains a cylindrical shape such that one edge forms one perimeter, and the opposing edge forms another perimeter and the width of the blank is the height of the cylinder, between the two perimeters and where the secondary blank section is integral and continuous with the blank, and extending from the second end, the secondary blank section having a width corresponding to the width of the blank, and where on either side of the secondary blank flaps extend, where each flap is provided with a connection flange, further extending from the flap, such that when the flaps are folded orthogonal to and along the blank's edges, the connection flanges will overlap, such that after the connector is received in the receiving section, the flaps are bent, whereby the connection flanges overlap and are assembled such that the secondary blank section overlaps part of the blank, forming a cavity between the blank and the secondary blank section, which cavity is limited by the blank and the secondary blank section, and the flaps along either edge.

10. The method according to claim 9, wherein an aperture may be formed either in the blank or the secondary blank section where it overlaps the cavity.

* * * * *